United States Patent [19]

Comstock

[11] Patent Number: 4,646,996

[45] Date of Patent: Mar. 3, 1987

[54] JIG FOR LIFTING PLASTERBOARD

[76] Inventor: Earl J. Comstock, 345 Iris Ct., St. Clair, Mo. 63077

[21] Appl. No.: 764,928

[22] Filed: Aug. 12, 1985

[51] Int. Cl.[4] ..... B66F 11/00

[52] U.S. Cl. ..... 248/165; 248/166; 248/371; 248/136; 248/157; 414/11

[58] Field of Search ..... 248/166, 434, 371, 133, 248/136, 139–142, 165, 421, 398, 157; 414/11

[56] References Cited

U.S. PATENT DOCUMENTS

| | | | |
|---|---|---|---|
| 708,346 | 9/1902 | Grondin | 248/139 |
| 836,551 | 11/1906 | Werner | 248/166 |
| 2,337,796 | 12/1943 | Baker . | |
| 2,371,561 | 12/1943 | Van Patten . | |
| 2,789,869 | 4/1957 | Hammagren . | |
| 2,805,062 | 9/1957 | Holmes | 248/166 |
| 2,815,132 | 12/1957 | Stone | 182/141 |
| 2,883,073 | 4/1959 | Morris . | |
| 3,058,602 | 10/1962 | Kilman | 414/11 |
| 3,198,395 | 8/1965 | McKinney | 248/139 |
| 4,369,987 | 1/1983 | Witherell | 248/166 |
| 4,449,879 | 5/1984 | Mercer | 414/11 |

*Primary Examiner*—Ramon S. Britts
*Assistant Examiner*—A. Chin-Shue
*Attorney, Agent, or Firm*—Glenn K. Robbins

[57] ABSTRACT

An adjustable jig for elevating plasterboard. The jig comprises a frame for supporting a rack which holds the plasterboard. Three telescopic members are supported by the frame and are individually adjustable to elevate the rack at a desired angular relation to fit uneven or angled ceilings. One of the telescopic members is provided with a hinged toggle operator whereby one side of the rack may be substantially lowered from the other side of the rack for easy loading of the plasterboard or for performing work upon the plasterboard before it is elevated. The toggle operator is easily moveable from a collapsed to an erect position to move the rack toward a lift position where the telescopic members may be adjusted by a workman as desired. The support frame has a base supporting the telescopic members and may be easily moved along a floor to any desired work position. The rack when not in use for lifting plasterboard may be installed in a vertical position from the frame and may be used as a standard to support a basketball backboard, signs or the like.

9 Claims, 10 Drawing Figures

JIG FOR LIFTING PLASTERBOARD

BACKGROUND OF THE INVENTION

In the past there have been problems in nailing or otherwise affixing plasterboard sometimes known as wallboard to a ceiling. If this is done manually, several workmen have been required to lift the plasterboard which is of considerable weight while other workmen nail the plasterboard in place. If the ceiling is of substantial height or angled, a stepladder or like means for the workmen to step on must be provided.

While adjustable lifts, elevators or the like have been provided in the past to elevate the plasterboard, these have generally been somewhat complex in structure and difficult for one man to operate and move from place to place. Such lifts have not been simple to assemble from a knock-down or collapsed position and have not provided an easy to load position for the plasterboard or move to selected positions underneath the ceiling and then elevate the plasterboard to the desired elevation and different angled positions for uneven or slanted ceiling of different angularity and elevation.

SUMMARY OF THE INVENTION

By means of this invention there has been provided a simple to assemble jig which can be readily constructed from a knockdown packed condition by one man. When erected, it may be slid simply along the floor from one position to another to the desired position underneath the ceiling area to which the plasterboard is to be affixed.

The jig is comprised of a frame which receives a plasterboard rack supported upon the frame in a three point relation. This support relation is provided by three upright members which are individually telescopically adjustable in order that the rack may be adjusted or elevated vertically in the desired angular relation to fit the plasterboard against a horizontal, uneven or slanted ceiling.

The three point support relation of the rack is effected by two of the upright members supporting one side of the rack in a cradle relation while the third upright member supports an opposite side of the rack in a hinged relation by means of a toggle operator. When the toggle operator is collapsed, one side of the rack is lowered to receive easily a sheet of plasterboard which may be rested upon the rack. At this point, the plasterboard may be simply cut, shaped or worked as desired.

For elevation of the plasterboard, the toggle operator is erected and locked and may be telescopically adjusted to a desired vertical position along with the other two upright telescopic members. By this adjustment, the rack and plasterboard may be elevated by a single workman against the ceiling and affixed thereto.

The frame is provided with a base which provides a full support for the rack and plasterboard. It may be simply moved along the floor when loaded with the plasterboard to the desired ceiling work area. A simple knock-down assembly ensures easy packing and erection on the job.

When not in use for plasterboard construction the rack may be affixed vertically to the frame and used as a standard for varied usage such as to support a basketball backboard, signs or the like.

The above features are objects of this invention. Further objects will appear in the detailed description which follows and will be further apparent to those skilled in the art.

There is shown in the accompanying drawing a preferred embodiment of this invention. It is to be understood that the drawing is for the purpose of description only and that the invention is not limited thereto.

IN THE DRAWING

Figure 3:
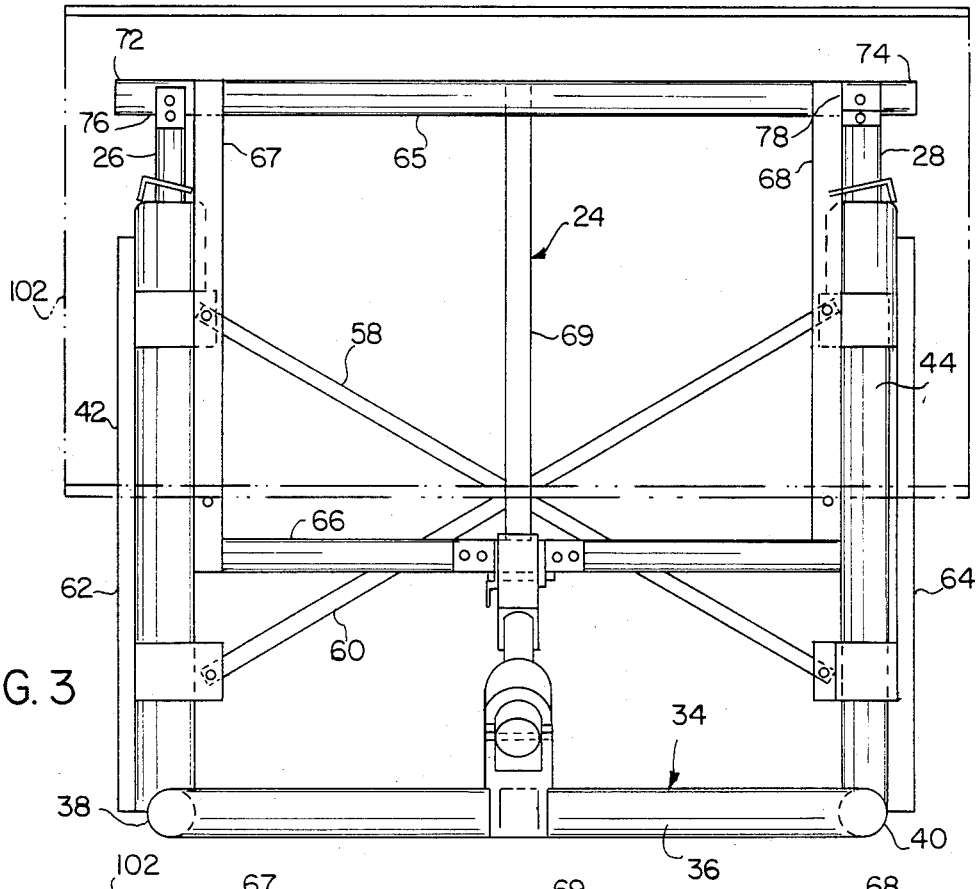
FIG. 3 is a view in front elevation of the jig in the rest position.
Figure 4:
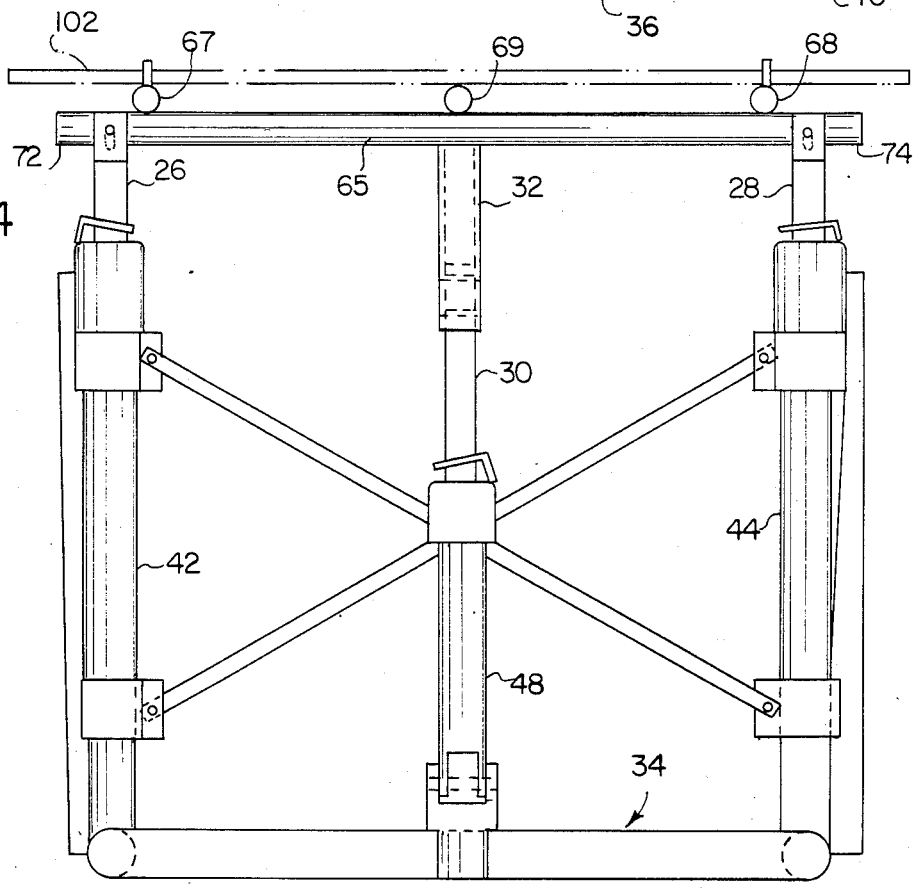
Figure 5:
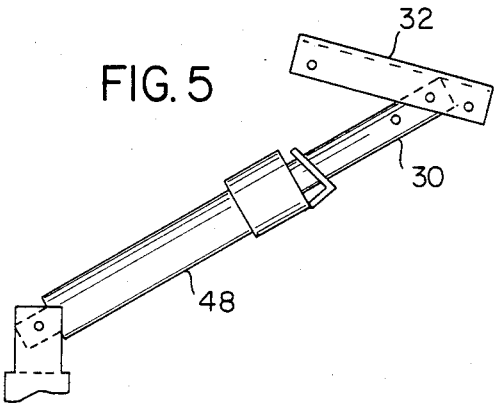
Figure 6:
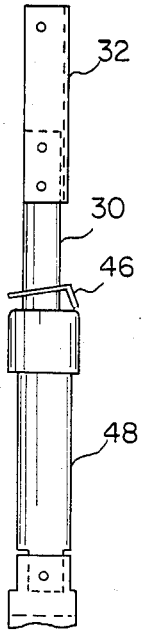
Figure 8:
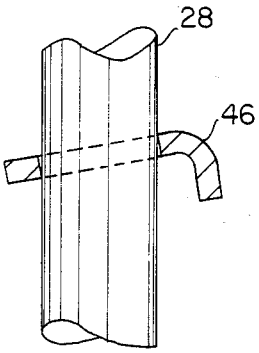
Figure 7:
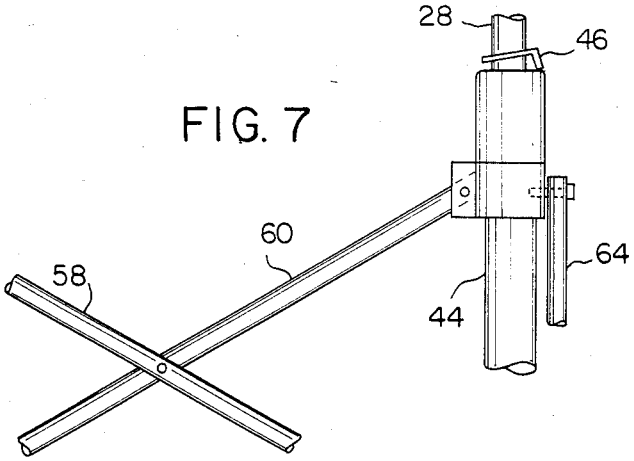
Figure 9:
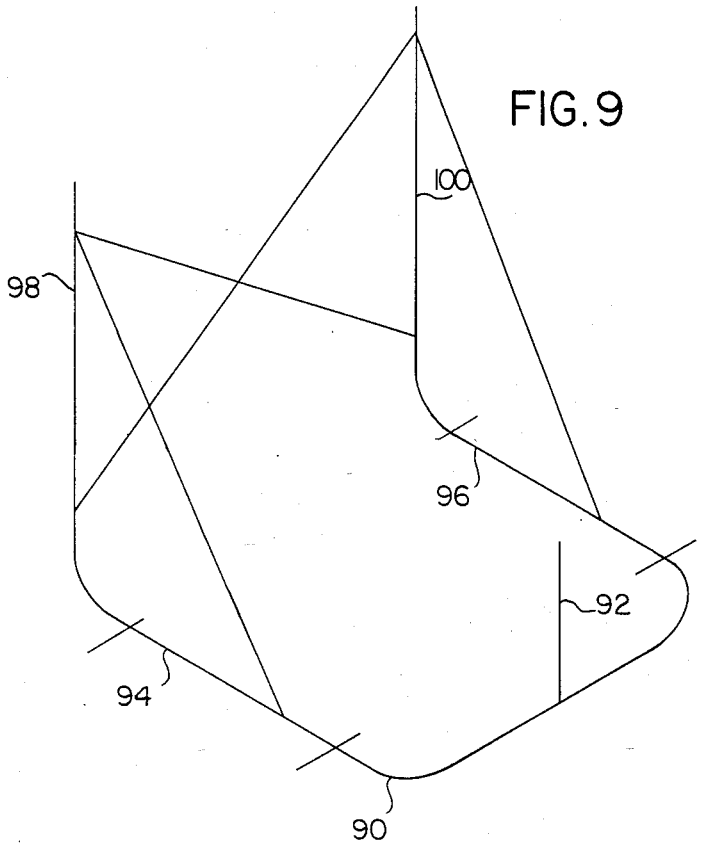
Figure 10:
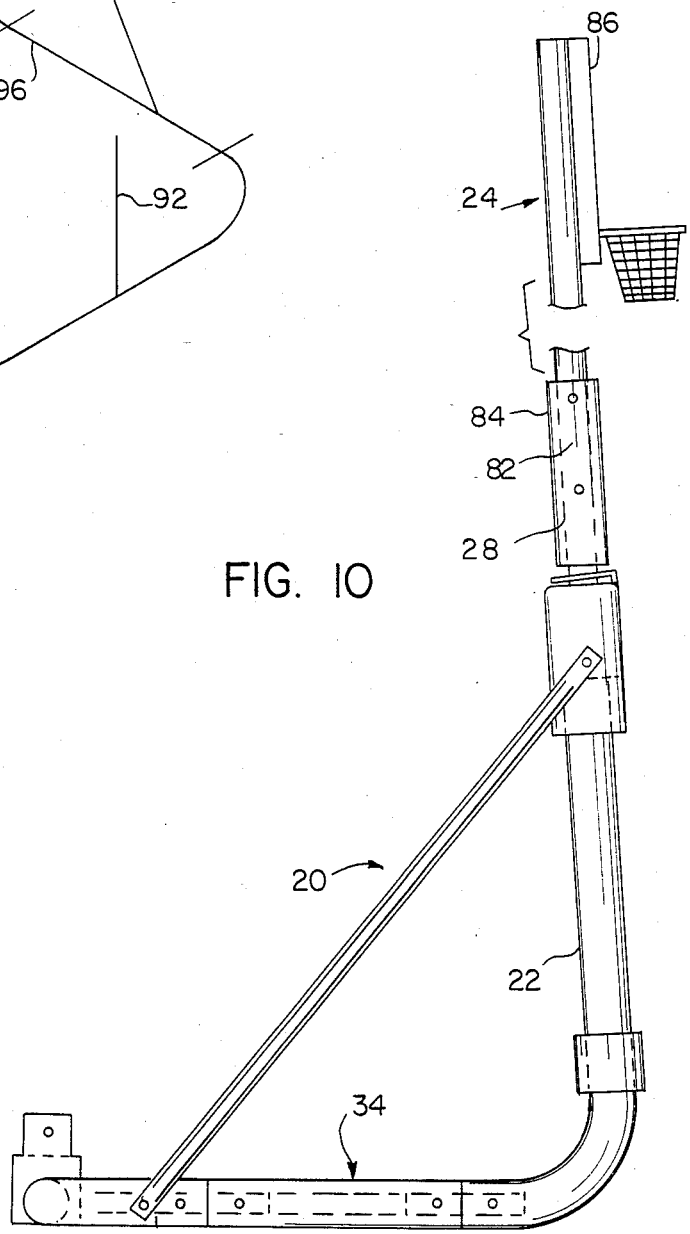

FIG. 4 a view similar to FIG. 3, but showing the jig erected in the lift position;

FIG. 5 is a fragmentary side view showing the toggle operator in the collapsed or rest position;

FIG. 6 is a view similar to FIG. 5 showing the toggle operator fully erected; FIG. 7 is a fragmentary view of the frame showing the brace connection;

FIG. 8 is a fragmentary view partly in section showing the adjustment stop lock;

FIG. 9 is a schematic view showing the break apart construction of the jig; and FIG. 10 is a view in side elevation of the jig with portions removed showing a modified construction for use as a basketball standard.

DESCRIPTION OF THE INVENTION

The jig of this invention for lifting plasterboard is generally indicated by the reference numeral 20 in FIGS. 1–4. It is comprised of a frame 22 which supports a plasterboard rack 24 upon a three point adjustable suspension comprised of telescopic members 26, 28 and 30. Two of the telescopic members 26 and 28 are supported in an upright position at the rear of the frame while the third telescopic member 30 is hingedly supported at the front of the frame and connected by a toggle operator 32 to the rack to provide for raising and lowering the rack from a collapsed position to a raised erected position.

The frame 22 has a generally L-shaped profile for stability in supporting the rack when loaded and to provide a base 34 to rest upon a floor or other flat surface. It is constructed of tubular metal for light weight but it will be understood that other materials of construction such as plastic may also be used. By this construction, the frame may be easily slid along the floor to a selected position underneath the ceiling or furnished with wheels as desired.

The base is comprised of a front cross piece 36 forming a bight connected on opposite sides to members 38 and 40 to form a U-shaped construction which can lay flat upon the floor. Intermediate members 41 connect the members 38 and 40 to L-shaped uprights 42 and 44 which slidably support the telescopic members 26 and 28 therewithin.

In order to lock the telescopic members 26 and 28 in selected positions of adjustment a slide lock 46 is employed as best shown in FIGS. 7 and 8. The slide lock is of conventional construction and, per se, forms no part of this invention.

The third telescopic member 30 is best shown in FIGS. 1, 2, 5 and 6. It is telescopically received in member 48 which is connected by a hinge 50 to the cross piece or bight 36 of the base of the frame. The member 30 is connected to the toggle operator 32 by a hinge pin 52, the toggle operator in turn is connected to the rack 24 by pin 54. When the rack is elevated by lifting anyone of the bottom of the rack, the member 48 or the toggle operator, the rack is erected from the collapsed position of FIG. 1 to the raised set-up position of FIG. 2 to move the toggle operator 32 in line with the telescopic member 30. In this position a lock pin 56 is inserted in registering holes and the telescopic member and toggle operator are locked together. The slide lock 46 is employed as previously described.

Figure 1:
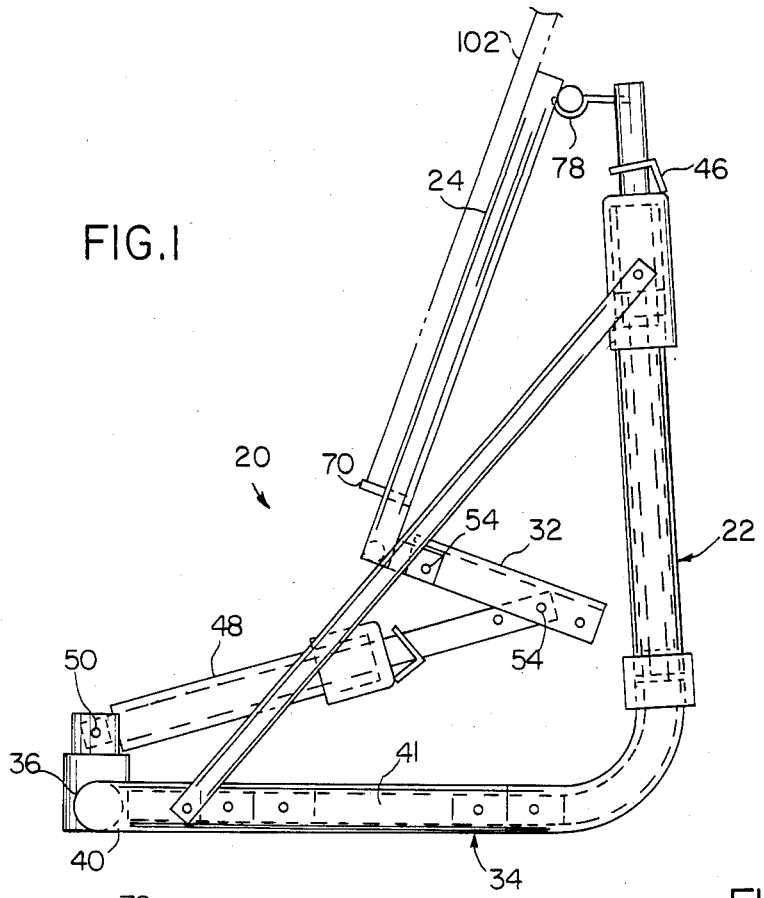
FIG. 1 is a view in elevation taken from the right side of the jig showing the rest position.

In order to provide rigidity and strength to the frame cross braces 58 and 60 may be connected diagonally to the upright support members 42 and 44 as shown in FIGS. 1 and 7. In like fashion, braces 62 and 64 may be employed connecting opposed sides of the base to the top portions of the upright members 42 and 44 as best shown in FIG. 1. Conventional bolts or quick connect pins may be employed for these connections as desired.

Figure 2:
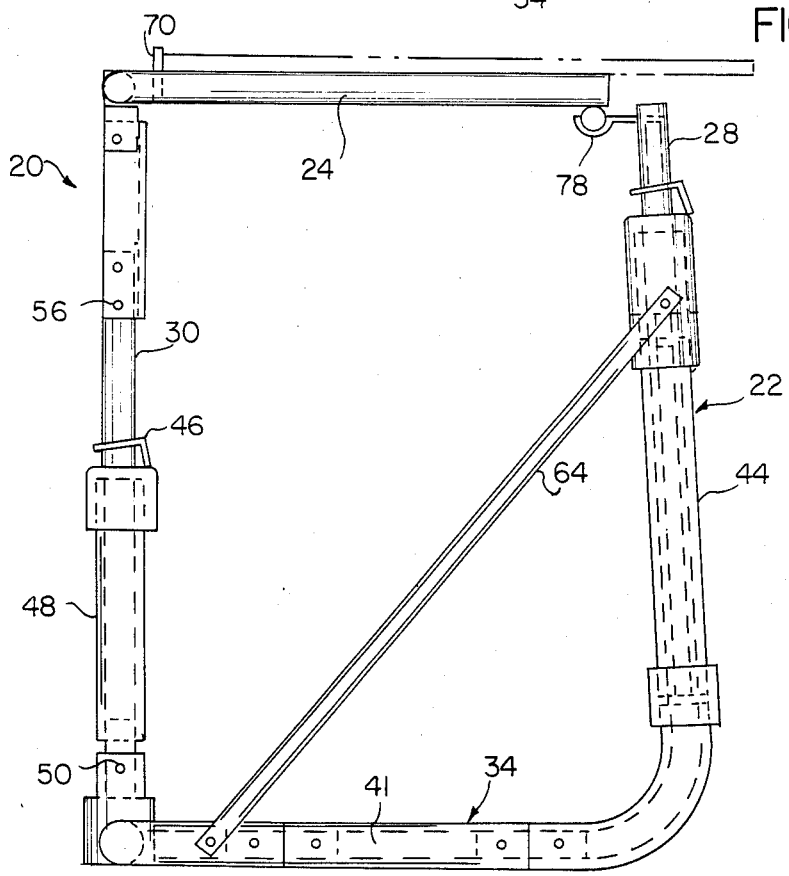
FIG. 2 is a view similar to FIG. 1, but showing the jig erected in the lift position.

The rack 24 is best shown in FIGS. 1 and 2. It is constructed like the frame of thin walled tubular metal. It is comprised of a top member 65 and a bottom member 66 connected by side members 67 and 68 and an intermediate brace 69. The side members are provided with stop pins 70 to hold the plasterboard in the rack lowered position. The top member of the rack has protruding end portions 72 and 74 which rest in cradles 76 and 78 affixed to the top ends of the telescopic members 26 and 28. This construction permits easy pivotal movement of the rack with respect to the telescopic members as it is moved from the collapsed position of FIG. 1 to the erected position of FIG. 2.

A modification of the jig is shown in FIG. 10 for use as a support standard when not being used in plasterboard work. The third telescopic member 30 and toggle operator 32 have for simplicity been removed but it will be understood that they may be retained with the rack of course being disconnected. The rack has a pair of stub shafts 82 which protrude beyond the top member of the rack. The stub shafts are received within the open top ends of the telescopic members 26 and 28 and connected thereto by sleeves 84. Alternatively, the telescopic members may be removed and the stub shafts may be interfitted within the upright members 42 and 44 of the support frame.

The rack when positioned vertically on top of the frame to serve as a support for a baskeball backboard 86 as shown or for general use as a portable frame to support signs or the like. Where desired the upright members 42 and 44 may be made vertical or in other slanted configurations than that shown in FIG. 10 for such employment as will be readily apparent.

USE

The jig may be easily assembled from a knock-down kit or the like. The frame is first connected using the main component or sub-assemblies as shown in FIG. 9.

The main components are designated by the reference numerals 90, 92, 96, 98 and 100. Component 90 comprises the front of the base and is comprised of the U-shaped cross pieces 38 and 40 while component 92 comprises the members 48, 30 and 32. Components 94 and 96 are the intermediate members 41 while, although shown separate, may be deleted by lenthening other portions of the base. Components 98 and 100 comprise the upright support members 42 and 48 within which the telescopic members 26 and 28 are received.

The components are provided in convenient to assemble subassemblies which are connected together by bolts or pins as previously described. The rear and front braces are easily fastened to provide a rigid frame.

The rack is readily supported by suspending the end portions 72 and 74 within the cradle 76 and 78. The bottom of the rack rests against the front braces and is pinned to the toggle operator 32 by the pin 54. The jig is then ready for use.

The user simply loads a sheet of wallboard 102 upon the rack by placing it thereupon in the collapsed position of FIG. 1 using the stop pins 70 as a stop for the wallboard. Work may then be performed as desired upon the wallboard.

Erection of the jig from the collapsed or rest position is simply effected by raising the rack from the slanted position of 60° or so, or operating the toggle 32 to the in-line position of FIG. 2 where the rack is substantially horizontal and locking with lock pin 56.

The rack with the loaded wallboard may then be elevated by elevating each of the telescopic members 26, 28 and 30 as necessary. This may be done in stages using the slide lock 46 as necessary until the wallboard is flush with the ceiling where it may then be nailed or otherwise affixed in the customary fashion.

After completion, the telescopic members are lowered and the rack is moved to the collapsed position by reversing the aforementioned operations. In the use of the jig as afore-described, the jig may be moved at any stage whether loaded or unloaded by using the base of the frame as a skid. This greatly facilitates the plasterboard set up and trim and fit installation by a single workman.

While such installation has been particularly described for wallboard, it will be apparent that other sheet material such as plywood, boards and even beams may be similarly utilized.

In the modification of FIG. 10 the jig when not being used for plasterboard, may be used as a portable support standard for a baskeball backboard or the like. The rack is disconnected and supported in vertical position upon the top of the frame and locked by the lock sleeves. This modification provides a convenient usage for the jig when not otherwise employed.

Various changes and modifications may be made within this invention as will be apparent to those skilled in the art. Such changes and modifications are within the scope and teaching of this invention as defined in the claims appended hereto.

What is claimed is:

1. A convertible jig assembly for elevating plasterboard or the like, or serving as a support standard for a basketball backboard or the like, said jig in a first assembled stage comprising a frame having a base supporting upright members at a rear portion of the base and at lest three adjustable members, at least two of said adjustable members being supported by said upright members and a third adjustable member having means supporting it in hinged toggle relation at a front of said base, said first two of said adjustable members having means for supporting a rack for receiving a sheet of wallboard and said third adjustable member having means connecting it to a front portion of said rack, said third adjustable member being moveable from a collapsed position to support the front portion of said rack in a substantially lowered slanted position with respect to the rear of the rack to an erected position to support the rack in a substantially level position, said toggle hinge means having a lock means engageable from the front of said base for locking the third adjustable member in the erected position, the adjustable members being individually telescopically adjustable to provide for lifting the plasterboard to selected level and slanted positions, the rear of the rack having a shaft means pivotally and readily removably, supported in a cradle connected to said first two adjustable members.

2. The jig of claim 1 in which slide lock means are provided for locking the telescopically adjustable members at selected positions of adjustment.

3. The jig of claim 1 in which said rack has stop means for supporting a sheet of plasterboard upon the rack in the slanted collapsed position to support the sheet in a rest position where it may be worked upon.

4. The jig of claim 1 in which said frame comprises a base, said base comprising U-shaped member supported flat upon a floor surface or the like, said U-shaped member serving as a skid for moving the frame along the floor as desired.

5. The jig of claim 4 in which said upright members are connected to the ends of legs forming said U-shaped member and said third adjustable member is hingedly connected to a middle portion of said U-shaped member.

6. The jig of claim 4 in which said third adjustable member is hingedly connected to a middle portion of said U-shaped member.

7. The jig of claim 1, and said jig in a second assembled stage, wherein said rack may be removed from the frame and supported in a vertical position upon the upright member to serve as a support standard for a basketball backboard or the like.

8. The jig of claim 7 in which said rack is provided with stub shafts adapted to protrude from said rack, and sleeve means are provided for locking said stub shafts upon telescopic members supported by the upright members of said frame.

9. A jig for elevating plasterboard or the like, said jig comprising a frame having a base supporting upright members at a rear portion of the base and at least three adjustable members, at least two of said adjustable members being supported by said upright members and a third adjustable member having means supporting it in hinged toggle relation at a front of said base, said first two of said adjustable members having means for supporting a rack for receiving a sheet of wallboard and said third adjustable member having means connecting it to a front portion of said rack, said third adjustable member being moveable from a collapsed position to support the front portion of said rack in a substantially lowered slanted position with respect to the rear of the rack to an erected position to support the rack in a substantially level position, said toggle hinge means having a lock pin engageable from the front of said base for locking the third adjustable member in the erected position, the adjustable members being individually telescopically adjustable to provide for lifting the plasterboard to selected level and slanted positions, the rear of the rack having a shaft means pivotally and readily removeably, supported in a cradle connected to said first two adjustable members.

* * * * *